US011503410B2

(12) United States Patent
Ji et al.

(10) Patent No.: US 11,503,410 B2
(45) Date of Patent: Nov. 15, 2022

(54) DISPLAY MODULE, DISPLAY DEVICE AND METHOD OF FORMING DISPLAY MODULE

(71) Applicant: BOE TECHNOLOGY GROUP CO., LTD., Beijing (CN)

(72) Inventors: Yaqian Ji, Beijing (CN); Yingming Liu, Beijing (CN); Xiufeng Li, Beijing (CN); Yanling Han, Beijing (CN); Wenchao Han, Beijing (CN); Yue Gou, Beijing (CN); Chenyang Zhang, Beijing (CN); Jing Yu, Beijing (CN); Wei Sun, Beijing (CN); Xiaoliang Ding, Beijing (CN); Yuzhen Guo, Beijing (CN); Peixiao Li, Beijing (CN)

(73) Assignee: Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/212,058

(22) Filed: Mar. 25, 2021

(65) Prior Publication Data

US 2022/0038821 A1 Feb. 3, 2022

(30) Foreign Application Priority Data

Jul. 31, 2020 (CN) ..... 202010763414.5

(51) Int. Cl.
*H04R 9/06* (2006.01)
*H04R 9/04* (2006.01)
(Continued)

(52) U.S. Cl.
CPC ..... *H04R 9/045* (2013.01); *G09F 9/302* (2013.01); *H04R 1/028* (2013.01); *H04R 7/045* (2013.01);
(Continued)

(58) Field of Classification Search
CPC ..... H04R 1/028; H04R 7/045; H04R 9/025; H04R 9/045; H04R 9/06; H04R 9/063;
(Continued)

(56) References Cited

U.S. PATENT DOCUMENTS 7,050,600 B2 * 5/2006 Saiki ..... H04R 1/028 381/186
7,151,837 B2 * 12/2006 Bank ..... H04R 7/045 381/431
(Continued)

FOREIGN PATENT DOCUMENTS

CN 105096778 A 11/2015
CN 107295447 A 10/2017
(Continued)

OTHER PUBLICATIONS

First Office Action, including Search Report, for Chinese Patent Application No. 202010763414.5, dated Oct. 11, 2021, 17 pages.
(Continued)

*Primary Examiner* — Huyen D Le
(74) *Attorney, Agent, or Firm* — Westman, Champlin & Koehler, P.A.

(57) ABSTRACT

A display module, a display device and a method of forming a display module are provided. The display module includes: a display sounding structure including a display panel and an auxiliary layer connected to the display panel; an excitation source configured to drive the display panel, the display module further includes a supporting frame, and the display panel is connected to the supporting frame through the auxiliary layer; or an excitation source configured to drive the auxiliary layer to vibrate and sound, the auxiliary layer is a transparent film layer arranged at a light-emitting side of the display panel cooperating with the display panel to form a sounding chamber in an enclosing manner.

20 Claims, 6 Drawing Sheets

(51) Int. Cl.

| | |
|---|---|
| ***G09F 9/302*** | (2006.01) |
| ***H04R 9/02*** | (2006.01) |
| ***H04R 7/04*** | (2006.01) |
| ***H04R 1/02*** | (2006.01) |

(52) U.S. Cl.
CPC ..... *H04R 9/025* (2013.01); *H04R 9/06* (2013.01); *H04R 2400/03* (2013.01); *H04R 2499/11* (2013.01); *H04R 2499/15* (2013.01)

(58) Field of Classification Search
CPC ..... H04R 2400/03; H04R 2440/05; H04R 2440/07; H04R 2499/11; H04R 2499/15; G09F 9/302
See application file for complete search history.

(56) References Cited

U.S. PATENT DOCUMENTS

| | | | | |
|---|---|---|---|---|
| 9,660,596 | B2 | 5/2017 | Whitwell | |
| 9,818,805 | B2 | 11/2017 | Choi et al. | |
| 10,200,772 | B2 | 2/2019 | Ahn et al. | |
| 10,845,632 | B2 | 11/2020 | Ham et al. | |
| 10,847,585 | B2 | 11/2020 | Choi et al. | |
| 10,911,851 | B2 | 2/2021 | Noh et al. | |
| 11,012,781 | B2 | 5/2021 | Kang et al. | |
| 11,189,667 | B2 | 11/2021 | Ha et al. | |
| 11,190,865 | B2 | 11/2021 | Zhou et al. | |
| 11,310,576 | B2 | 4/2022 | Ahn et al. | |
| 2001/0026625 | A1* | 10/2001 | Azi | H04R 7/045 381/152 |
| 2015/0341714 | A1 | 11/2015 | Ahn et al. | |
| 2016/0219353 | A1 | 7/2016 | Whitwell | |
| 2017/0287990 | A1 | 10/2017 | Choi et al. | |
| 2017/0289694 | A1* | 10/2017 | Choi | H04R 7/045 |
| 2018/0053813 | A1 | 2/2018 | Choi et al. | |
| 2019/0004566 | A1* | 1/2019 | Lee | H04R 9/025 |
| 2019/0116406 | A1 | 4/2019 | Ahn et al. | |
| 2019/0129231 | A1 | 5/2019 | Ham et al. | |
| 2020/0059713 | A1 | 2/2020 | Noh et al. | |
| 2020/0068311 | A1 | 2/2020 | Kang et al. | |
| 2020/0212136 | A1 | 7/2020 | Ha et al. | |
| 2020/0233629 | A1 | 7/2020 | Yeon et al. | |
| 2021/0297758 | A1 | 9/2021 | Zhou et al. | |

FOREIGN PATENT DOCUMENTS

| | | | |
|---|---|---|---|
| CN | 107409257 | A | 11/2017 |
| CN | 109729480 | A | 5/2019 |
| CN | 109842701 | A | 6/2019 |
| CN | 209057357 | U | 7/2019 |
| CN | 110351402 | A | 10/2019 |
| CN | 110572502 | A | 12/2019 |
| CN | 110830613 | A | 2/2020 |
| CN | 111383587 | A | 7/2020 |
| CN | 111464914 | A | 7/2020 |
| CN | 111711900 | A | 9/2020 |
| DE | 102019122438 | A1 | 2/2020 |
| KR | 20200083208 | A | 7/2020 |

OTHER PUBLICATIONS

Second Office Action, including Search Report, for Chinese Patent Application No. 202010763414.5, dated May 26, 2022, 17 pages.

* cited by examiner

DISPLAY MODULE, DISPLAY DEVICE AND METHOD OF FORMING DISPLAY MODULE

CROSS-REFERENCE TO RELATED APPLICATIONS

The present application claims priority to Chinese Patent Application No. 202010763414.5 filed in China on Jul. 31, 2020, which is incorporated herein by reference in its entirety.

TECHNICAL FIELD

The present disclosure relates to the technical field of display, in particular to a display module, a display device and a method of forming a display module.

BACKGROUND

With the development of display technology, consumers not only focus on the requirements of picture quality and definition of display devices, but also pay more attention to the output effect of sound. Thus, the screen sounding technology which can realize a sound-picture parallel effect becomes one of the current demands of the display device market.

According to the technical scheme of screen sounding, a display screen is used for replacing a loudspeaker diaphragm, and an exciter is configured to drive the display screen to vibrate and sound. According to the principle of a flat-panel loudspeaker, a bending vibration mode is adopted, under any frequency, a plurality of small vibrations with random phases are distributed on a diaphragm, each small vibration sounds independently, and a sum of the small vibrations forms a required frequency response. However, when the loudspeaker diaphragm is replaced by the display screen, the exciter is used to drive the display screen to vibrate and sound, and when the amplitude in a low frequency region of the loudspeaker is large, the risk of screen breakage and the like may be caused. In addition, when the screen is used as the loudspeaker diaphragm, because the mechanical parameter adjustability of the screen is small, the adjustment range of the sound quality effect is small.

SUMMARY

A display module is provided in the present disclosure, including:

a display sounding structure including a display panel and an auxiliary layer connected to the display panel;

an excitation source configured to drive the display panel, the display module further includes a supporting frame, and the display panel is connected to the supporting frame through the auxiliary layer; or an excitation source configured to drive the auxiliary layer to vibrate and sound, the auxiliary layer is a transparent film layer arranged at a light-emitting side of the display panel cooperating with the display panel to form a sounding chamber in an enclosing manner.

Optionally, a first member in the excitation source is arranged on the auxiliary layer, and a second member in the excitation source is arranged on the display panel; the first member is one of a voice coil and a magnetic element, and the second member is the other of the voice coil and the magnetic element.

Optionally, the display panel includes a plurality of sub-pixel units arranged in an array, an orthographic projection of the first member onto a plane of the display panel is located in a spacing area between adjacent sub-pixel units; the second member is arranged on the same layer as the sub-pixel units of the display panel, and is arranged in the spacing area between adjacent sub-pixel units.

Optionally, the first member is a continuous preset pattern on the auxiliary layer.

Optionally, an isolation frame is arranged between the auxiliary layer and the display panel, the isolation frame is connected to the display panel and the auxiliary layer, the isolation frame forms the sounding chamber in an enclosing manner, and the first member and the second member are both located within the sounding chamber.

Optionally, the first member is a voice coil, and an electric connection line configured to connect the voice coil to a circuit board of the display panel is arranged in the isolation frame.

Optionally, the excitation source further includes a magnetic post, the magnetic post is arranged on the display panel or the auxiliary layer on which the voice coil is arranged, and the voice coil is arranged around the magnetic post.

Optionally, the display panel further includes a circuit board located on a side, away from the auxiliary layer, of the display panel; a first end surface of the second member is fixedly connected to a surface, away from the auxiliary layer, of the display panel, and a second end surface, opposite to the first end surface, of the second member is fixedly connected to the circuit board.

Optionally, the excitation source further includes a magnetic post, the second member is a voice coil, and the magnetic post is located on the surface, away from the auxiliary layer, of the display panel.

Optionally, the magnetic element includes a first magnetic pole and a second magnetic pole, a direction from the first magnetic pole to the second magnetic pole is parallel to a direction from the auxiliary layer to the display panel.

Optionally, the display panel is connected to the supporting frame through the auxiliary layer, the auxiliary layer is arranged at a side, away from a display surface, of the display panel, and the supporting frame is fixedly connected to an edge of the display panel.

Optionally, the auxiliary layer includes a first portion fixedly connected to the display panel, a second portion connecting the supporting frame and the display panel, and a bent portion in a bent state located between the first portion and the second portion.

Optionally, the second portion is connected to the display panel through a buffer layer.

Optionally, the excitation source is fixedly connected to the first portion of the auxiliary layer.

Optionally, the first portion of the auxiliary layer is provided with a through-hole to expose a partial surface of the display panel, and the excitation source is in direct contact with and fixedly connected to the partial surface of the display panel.

Optionally, the display panel is connected to the supporting frame through the auxiliary layer, the auxiliary layer is parallel to an extension direction of the display panel, a buffer layer is arranged between the auxiliary layer and the display panel, and an orthographic projection of the buffer layer onto a plane of the supporting frame does not coincide with the supporting frame.

Optionally, the excitation source is fixedly connected to the auxiliary layer.

Optionally, a plurality of excitation sources are provided, and each excitation source is arranged corresponding to an area of the display panel to form a sounding unit.

The present disclosure further provides a display device including the display module as described above.

A method of forming a display module is further provided in the present disclosure, which is used for forming the display module as described above, and the method includes:

forming a display sounding structure including a display panel and an auxiliary layer connected to the display panel;

forming an excitation source configured to drive the display panel, the display module further includes a supporting frame, and the display panel is connected to the supporting frame through the auxiliary layer; or forming an excitation source configured to drive the auxiliary layer to vibrate and sound, the auxiliary layer is a transparent film layer arranged at a light-emitting side of the display panel cooperating with the display panel to form a sounding chamber in an enclosing manner.

DETAILED DESCRIPTION

In order to make the technical problems to be solved, technical solutions and advantages of the present disclosure clear, a detailed description will be given below with reference to the accompanying drawings and specific embodiments.

Figure 1:
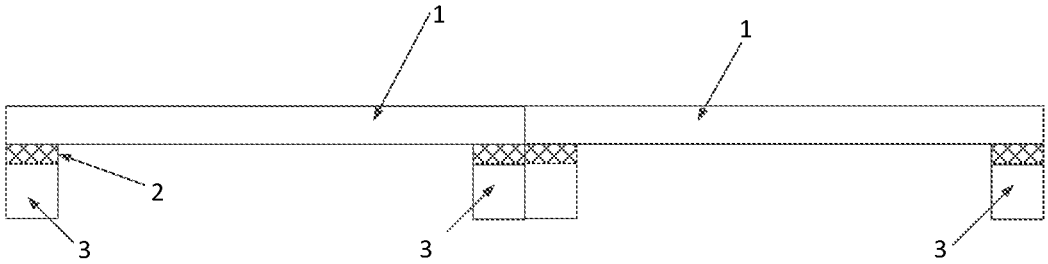
FIG. 1 is a schematic structural diagram of a display module that is usually capable of realizing screen sounding.

FIG. 1 is a schematic structural diagram of a display module that is usually capable of realizing screen sounding, a display panel 1 is adhered and fixed on a support 3 through a glue layer 2, so that edges of the display panel 1 are completely fixed, and an excitation source connected to the display panel 1 is used for exciting the display panel 1 to be in a bending vibration mode, so that a plurality of small vibrations with random phases distributed on the whole display panel 1 sound independently to form a sound of a required frequency response. According to the structure for realizing screen sounding in the related art, as the display panel 1 is directly and fixedly connected to the support 3, the boundary is completely fixed, vibration sounding is not facilitated, and a large screen breakage risk exists.

To solve the above problems, some embodiments of the present disclosure provide a display module including:

a supporting frame;

a display sounding structure arranged on the supporting frame, the display sounding structure includes a display panel and an auxiliary layer connected to the display panel; and an excitation source, wherein the excitation source is configured to drive the display panel or the auxiliary layer to vibrate and sound; when the excitation source drives the display panel to vibrate and sound, the display panel is connected to the supporting frame through the auxiliary layer; when the excitation source drives the auxiliary layer to vibrate and sound, the auxiliary layer is a transparent film layer arranged at a light-emitting side of the display panel cooperating with the display panel to form a sounding chamber in an enclosing manner.

According to the display module of some embodiments of the present disclosure, the auxiliary layer connected to the display panel is provided, and is combined with the display panel to form the display sounding structure, the excitation source is configured to drive the display panel or the auxiliary layer to sound; if the excitation source drives the display panel to sound, the display panel is connected to the supporting frame through the auxiliary layer, so that the display panel is not contacted with the supporting frame in the vibration process, and the risk of screen breakage is avoided; if the excitation source drives the auxiliary layer to sound, the auxiliary layer suspended relative to the display panel can be adopted to realize a screen sounding effect, the direct sounding of the display panel is avoided, and the problem of screen breakage is also avoided.

In some embodiments of the present disclosure, the auxiliary layer is a transparent film layer disposed on a light-emitting side of the display panel, the auxiliary layer is suspended on the display panel relative to the display panel, and a screen sounding effect is achieved by using vibration of the auxiliary layer. Because the display panel does not directly vibrate and sound, the problem of screen breakage can be effectively avoided, and the service life of the display panel can be prolonged.

In some embodiments of the present disclosure, optionally a first member in the excitation source is disposed on the auxiliary layer and a second member in the excitation source is disposed on the display panel; where the first member is one of a voice coil and a magnetic element, and the second member is the other of the voice coil and the magnetic element.

Figure 2:
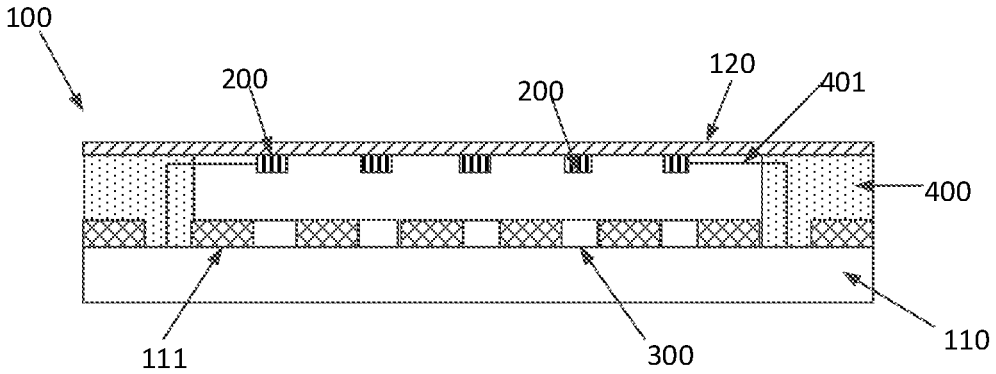
FIG. 2 is a schematic sectional diagram of the display module according to some embodiments of the present disclosure.
Figure 3:
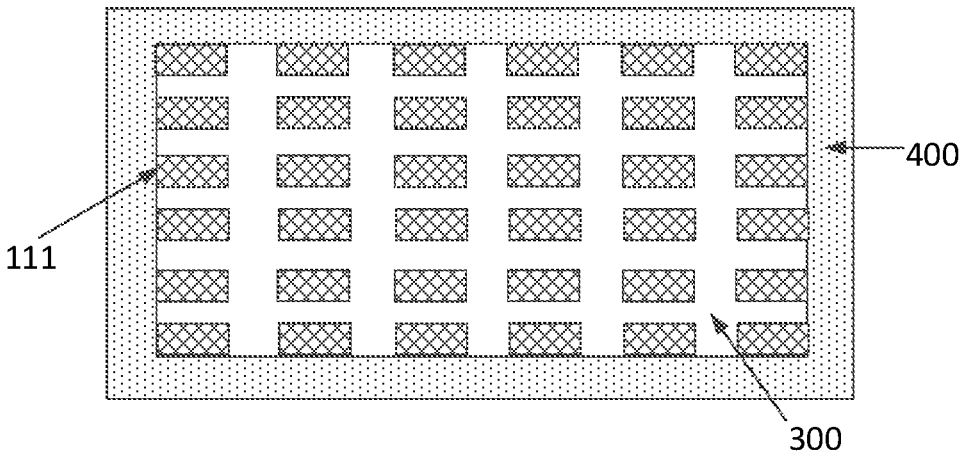
FIG. 3 is a schematic structural diagram of an arrangement of a magnetic element on a display panel in the embodiment of FIG. 2.

FIG. 2 is a schematic sectional diagram of the display module according to some embodiments of the present disclosure; FIG. 3 is a schematic structural diagram of an arrangement of a magnetic element on a display panel; and FIG. 4 is a schematic structural diagram of an arrangement of a voice coil on an auxiliary layer.

Figure 4:
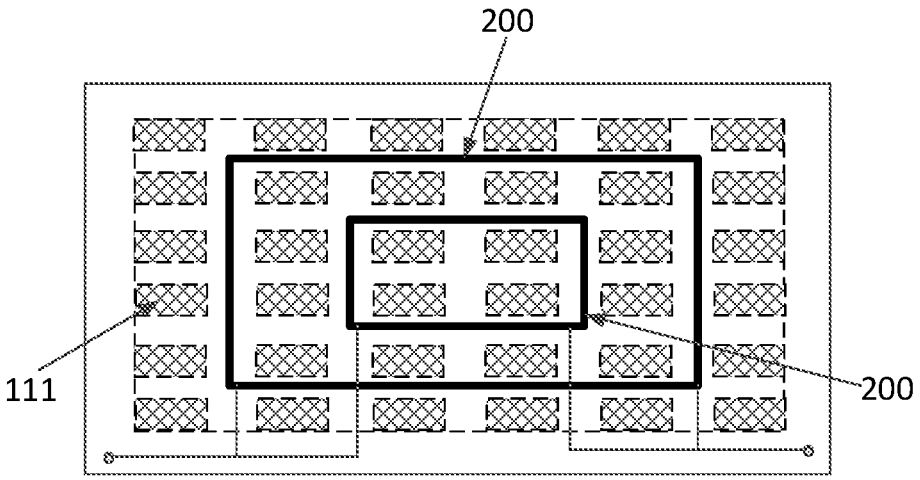
FIG. 4 is a schematic structural diagram of an arrangement of a voice coil on an auxiliary layer in the embodiment of FIG. 2.

Referring to FIGS. 2 to 4, a display module 100 includes a display panel 110 and an auxiliary layer 120 arranged on the display panel 110, where the auxiliary layer 120 is a diaphragm suspended above the display panel 110. Optionally, an edge of the auxiliary layer 120 is connected to the display panel 110 through an isolation frame 400, and the auxiliary layer 120 is spaced from the display panel 110 to form a sounding chamber. Optionally, the auxiliary layer 120 may be made of a transparent PET or a transparent PI material having preferable vibration characteristics.

The display panel 110 includes a plurality of sub-pixel units 111 arranged in an array. A voice coil and a magnetic element in an excitation source are arranged on the auxiliary layer 120 and the display panel 110 separately. When a first member of the voice coil and the magnetic element is arranged on the auxiliary layer 120, an orthographic projection of the first member on a plane of the display panel 110 is located in a spacing area between adjacent sub-pixel units 111; when a second member is disposed on the display panel 110, the second member is disposed on the same layer as the sub-pixel units 111 of the display panel 110 and is disposed in a spacing area between adjacent sub-pixel units 111.

In some embodiments of the present disclosure, as shown in FIGS. 2 to 4, optionally, the first member is a voice coil 200 disposed on the auxiliary layer 120 and is disposed on a surface, facing the display panel 110, of the auxiliary layer 120; an orthographic projection of the voice coil 200 onto a plane of the display panel 110 is located in a spacing area between adjacent sub-pixel units 111 as shown in FIG. 4; optionally, the second member is a magnetic element 300 disposed on the display panel 110 and disposed on the same layer as the sub-pixel units 111, is located in a spacing area between adjacent sub-pixel units 111 as shown in FIG. 3.

Optionally, the voice coil 200 arranged on the auxiliary layer 120 is of a patterned design, and a size of the voice coil 200 is smaller than a size of the spacing area between the adjacent sub-pixel units 111 to prevent the display effect from being affected.

Optionally, the voice coil 200 on the auxiliary layer 120 may be made of any one of copper, aluminum, and copper clad aluminum materials.

Optionally, the voice coil 200 may be made of a transparent material and printed as patterns on the entire auxiliary layer 120.

When the voice coil 200 is made of a non-transparent material, in order to prevent the non-transparent voice coil 200 from affecting the display effect during vibration, a cross-sectional size of the voice coil 200 should be smaller than a width size of the spacing area between the adjacent sub-pixel units 111, for example, the width size of the spacing area between the adjacent sub-pixel units 111 is 500 um, and a width size of the voice coil 200 may be 450 um.

In some embodiments of the present disclosure, as shown in FIG. 3, an isolation glue is filled between adjacent sub-pixel units 111. In addition, the isolation frame 400 is arranged between the auxiliary layer 120 and the display panel 110 and forms the sounding chamber in an enclosing manner, where the first member (such as a voice coil) and the second member (such as a magnetic element) of the excitation source are arranged in the sounding chamber.

Optionally, as shown in FIG. 3, the isolation glue between the adjacent sub-pixel units 111 is integrally connected to the isolation frame 400 and manufactured in the same process.

When the voice coil 200 is arranged on the auxiliary layer 120, an electric connection line 401 is arranged in the isolation frame 400 through a through-hole and is used for connecting the voice coil 200 with a circuit board of the display panel 110 so that an audio signal can be input into the voice coil 200 through the electric connection line 401.

In some embodiments of the present disclosure, the magnetic element 300 includes a first magnetic pole and a second magnetic pole, where a direction from the first magnetic pole to the second magnetic pole is parallel to a direction from the auxiliary layer 120 to the display panel 110. Optionally, the first and second magnetic poles of the plurality of magnetic elements 300 may be aligned in the same direction within one sounding chamber.

In one sounding chamber, magnetization directions of the plurality of magnetic elements 300 are all perpendicular to the voice coil 200, i.e. magnetic field directions of the plurality of magnetic elements 300 are the same and are perpendicular to a plane of the voice coil 200; in the case where an AC audio signal is input into the voice coil 200, the voice coil 200 generates a varying vertical magnetic field to generate an electromagnetic force attracting or repelling a magnetic field of the magnetic element 300, under the action of the electromagnetic force, the voice coil 200 drives the auxiliary layer 120 to vibrate, thereby generating a sound.

In some embodiments of the present disclosure, optionally, as shown in FIG. 3, the magnetic element 300 disposed on the display panel 110 may be deposited as patterns at the spacing area between the adjacent sub-pixel units 111; optionally, the magnetic elements 300 may be distributed between the sub-pixel units 111 over the entire area of the sounding chamber, or may be spaced between the sub-pixel units 111 within the sounding chamber. In addition, as shown in FIG. 4, the pattern shape of the voice coil 200 on the auxiliary layer 120 may be any one of a circular pattern, a square pattern, and a spiral pattern, and the number of the voice coil 200 may be one or at least two, which is not specifically limited, as long as the voice coil 200 can generate a magnetic field perpendicular to a direction of the display panel 110. Optionally, when a plurality of voice coils 200 are arranged in the same sounding chamber, the plurality of voice coils 200 may be arranged in order from inside to outside, and the plurality of voice coils 200 may input audio signals in the same direction.

It should be noted that in some embodiments of the present disclosure, the isolation frame 400 is made by filling with the isolation glue, where the isolation glue has a certain light transmittance, and a thickness of the manufactured isolation frame 400 can also meet the light transmittance requirements so as not to affect the normal display effect.

Figure 5:
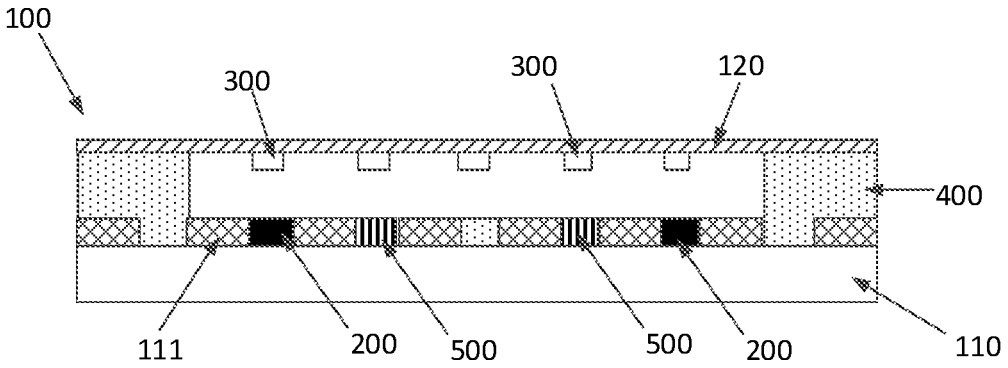
FIG. 5 is a schematic sectional diagram of the display module according to some embodiments of the present disclosure.

In some embodiments of the present disclosure, as shown in FIG. 5, the voice coil 200 in the excitation source is disposed on the display panel 110, and the magnetic element 300 is disposed on the auxiliary layer 120.

Figure 6:
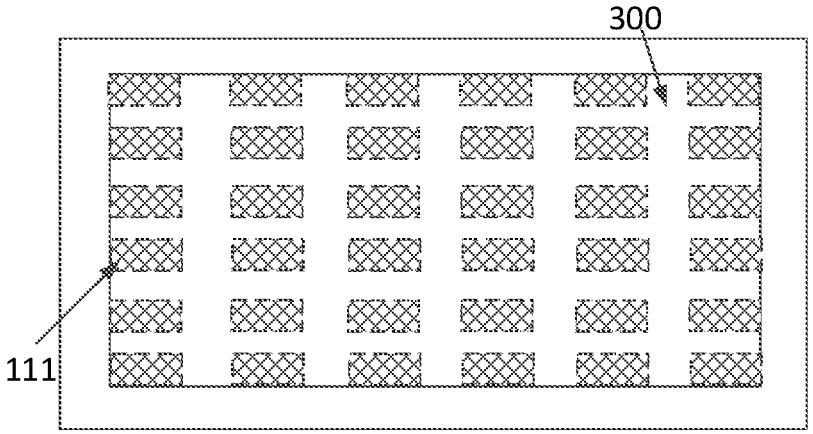
FIG. 6 is a schematic structural diagram of an arrangement of a magnetic element on an auxiliary layer in the embodiment of FIG. 5.
Figure 7:
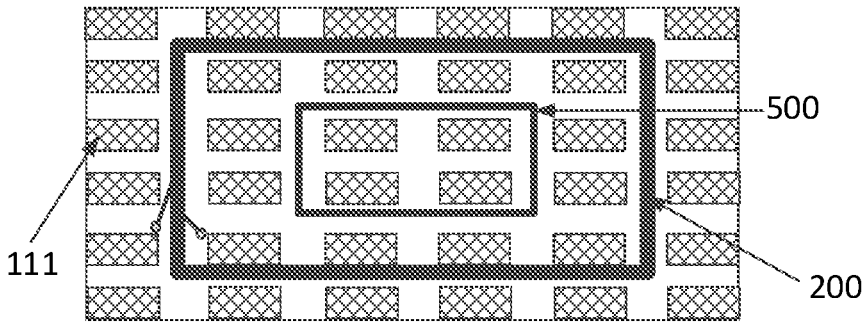
FIG. 7 is a schematic structural diagram of an arrangement of a voice coil on a display panel in the embodiment of FIG. 5.

Optionally, as shown in FIG. 6, an orthographic projection of the magnetic element 300 onto a plane of the display panel 110 is located at a spacing area between adjacent sub-pixel units 111; as shown in FIG. 7, the voice coil 200 is disposed on the same layer as the sub-pixel units 111 and is located in a spacing area between adjacent sub-pixel units 111.

The voice coil 200 arranged on the display panel 110 may be connected to a circuit board arranged at the other side of the display panel 110 through an electric connection line arranged in a through-hole of the display panel 110 so that an audio signal can be input into the voice coil 200 through the circuit board.

Optionally, the magnetic elements 300 may be deposited as patterns on the auxiliary layer 120 to form a continuous preset pattern or spaced structures. Optionally, the first and second magnetic poles of the plurality of magnetic elements 300 may be aligned in the same direction perpendicular to the plane of the voice coil 200 within the same sounding chamber.

In addition, the pattern shape of the voice coil 200 arranged on the display panel 110 may be any one of a circular pattern, a square pattern, and a spiral pattern, and the number may be one or more.

Optionally, in some embodiments of the present disclosure, the excitation source may further include a magnetic post 500 disposed on the display panel 110 or the auxiliary layer 120 on which the voice coil 200 is disposed, and the voice coil 200 is disposed around the magnetic post 500. For example, as shown in FIG. 7, on the display panel 110, the magnetic post 500 is provided inside the voice coil 200. Optionally, the magnetic post 500 may be made of a material with a good permeability such as soft iron. Through the arrangement of the magnetic post 500, the magnetic line distribution in a range enclosed by the voice coil 200 is adjusted, e.g. a magnetic field strength in this range can be enhanced.

It should be noted that, in order to prevent the display effect from being affected, an orthographic projection of the magnetic element 300 onto a plane of the display panel 110 is located in a spacing area between adjacent sub-pixel units 111, and a width of the magnetic element is smaller than a width of the spacing area; and, the voice coil 200 is located in a spacing area between adjacent sub-pixel units 111, and a width of the voice coil is smaller than a width of the spacing area.

Figure 8:
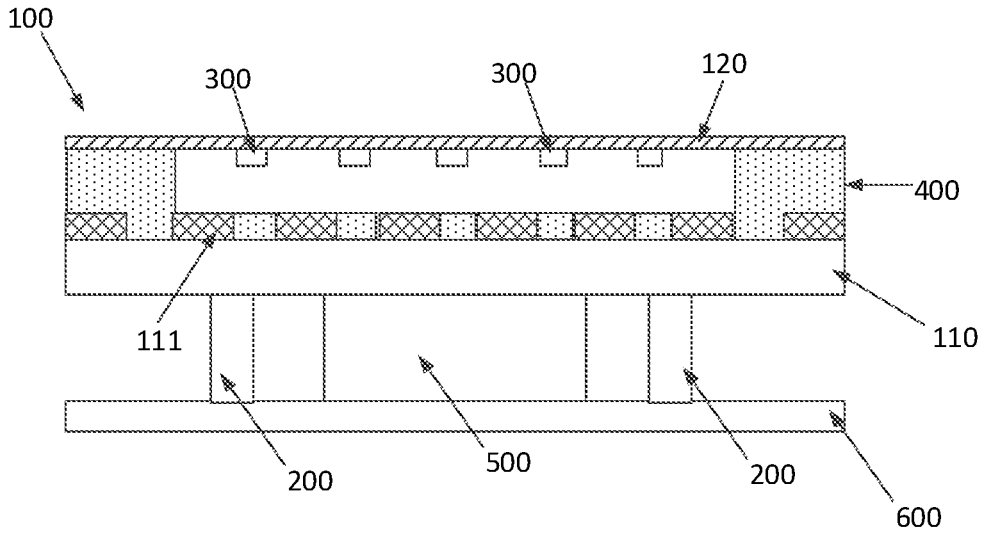
FIG. 8 is a schematic sectional diagram of the display module according to some embodiments of the present disclosure.

As shown in FIG. 8, the magnetic element 300 in the excitation source is arranged on the auxiliary layer 120, and the voice coil 200 is arranged at a side, away from the auxiliary layer 120, of the display panel 110.

A circuit board 600 is arranged at the side, away from the auxiliary layer 120, of the display panel 110, one end surface of the voice coil 200 is fixedly connected to a surface, away from the auxiliary layer 120, of the display panel 110, and the other end surface of the voice coil 200 is fixedly connected to the circuit board 600. Optionally, the voice coil 200 may be fixed to the display panel 110 and the circuit board 600 respectively by an adhesive glue.

An orthographic projection of the magnetic element 300 arranged on the auxiliary layer 120 onto a plane of the display panel is located in a spacing area between adjacent sub-pixel units 111; the specific implementation structure of the magnetic element 300 may be as described above with reference to FIG. 5 and will not be described in detail herein.

The voice coil 200 is on the circuit board 600 and may be directly connected to the circuit board 600 through an electrical connection line to enable input of an audio signal to the voice coil 200. Since the voice coil 200 is directly disposed on the circuit board 600, the structure and forming process of the display module can be significantly simplified.

Optionally, the pattern shape of the voice coil 200 on the circuit board 600 may be any one of a circular pattern, a square pattern, and a spiral pattern, and the number of the voice coils 200 may be one or a plurality of the voice coils 200 may be arranged in order from inside to outside.

The principle that the auxiliary layer 120 is driven to vibrate by the voice coil 200 and the magnetic element 300 is the same as that in the above-mentioned embodiment, when an AC audio signal is input into the voice coil 200, the voice coil 200 generates a varying vertical magnetic field to generate an electromagnetic force attracting or repelling a magnetic field of the magnetic element 300, and under the action of the electromagnetic force, the voice coil 200 drives the auxiliary layer 120 to vibrate to generate a sound. Therefore, although the voice coil 200 is disposed on the circuit board 600 on the side, away from the auxiliary layer 120, of the display panel 110, a screen sounding effect can be achieved as long as the magnetic element 300 is disposed within the range of the magnetic field generated by the voice coil 200.

As shown in FIG. 8, optionally, the excitation source further includes the magnetic post 500 located within the voice coil 200, and the magnetic post 500 is fixed on the circuit board 600 and is used for adjusting a magnetic field strength of the magnetic field generated by the voice coil 200 when an AC audio signal is input.

It should be noted that the magnetic member 300 may be arranged on the circuit board 600 and the voice coil 200 may be arranged on the auxiliary layer 120 in addition to the voice coil 200 being arranged on the circuit board 600 on the side of the display panel 110 and the magnetic member 300 being arranged on the auxiliary layer 120. The specific implementation structure of the voice coil 200 disposed on the auxiliary layer 120 may refer to FIG. 2 in conjunction with the above description and will not be described in detail. When the magnetic element 300 is disposed on the circuit board 600, optionally, the magnetic element 300 is located within the strength range of the magnetic field of the voice coil 200 and may not be limited by the arrangement of the sub-pixel units 111 since the display is not blocked.

Figure 9:
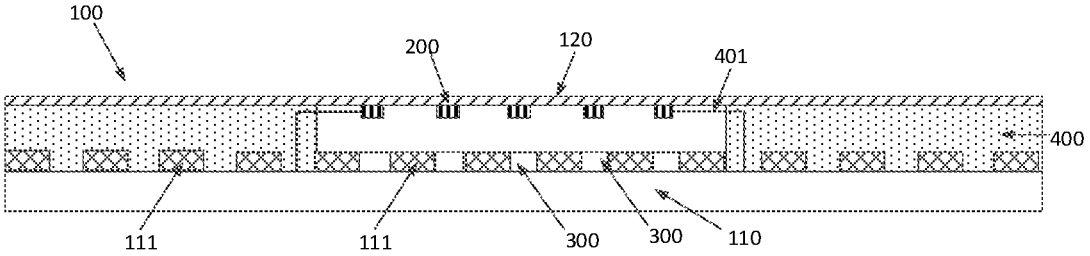
FIG. 9 is a schematic sectional diagram of the display module according to some embodiments of the present disclosure.

In some embodiments of the present disclosure, optionally, a size of the sounding chamber formed by the combination of the display panel 110 and the auxiliary layer 120 may correspond to a size of a display area of the display panel 110, or may be smaller than the size of the display area, as shown in FIG. 9, when the size of the sounding chamber is smaller than the size of the display area, between the display panel 110 and the auxiliary layer 120, an area outside the sounding chamber may be filled with an isolation glue to ensure that the entire auxiliary layer 120 is at the same level as the display panel 110.

According to some embodiments of the present disclosure, optionally, a plurality of excitation sources are provided, and each excitation source is arranged corresponding to an area of the display panel to form a sounding unit.

Figure 10:
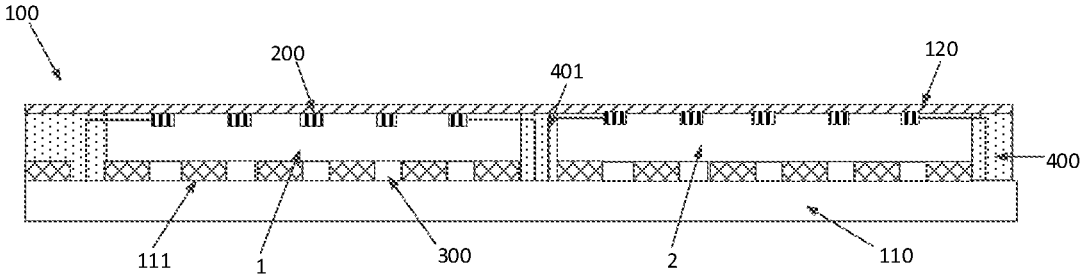
FIG. 10 is a schematic sectional diagram of the display module according to some embodiments of the present disclosure.

Taking the arrangement of one excitation source on the display module as shown in FIG. 2, the display module is provided with two excitation sources as an example, as shown in FIG. 10, the auxiliary layer 120 and the display panel 110 are spaced apart to form two sounding chambers, and the two sounding chambers are spaced apart by the isolation frame 400. The magnetic element 300 and the voice coil 200 are disposed within each sounding chamber.

The arrangement of the magnetic element 300 and the voice coil 200 in the sounding chamber may refer to FIG. 2 in conjunction with the above description and will not be described again herein. Of course, the arrangement of the magnetic element 300 and the voice coil 200 in each sounding chamber may be as in any one of the embodiments described above and will not be described in detail.

As shown in FIG. 10, the two sounding chambers are correspondingly formed into a first sounding unit 1 and a second sounding unit 2 respectively, and when the two sounding units are driven at the same time, full-screen vibration sounding can be realized; in the case where a sounding unit is separately driven, regional sounding can be achieved.

Figure 11:
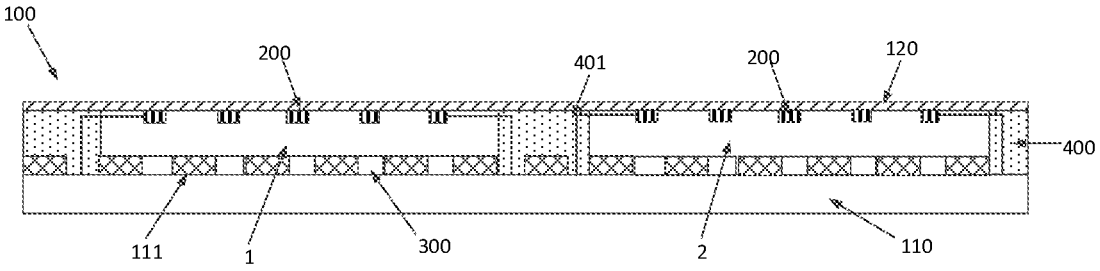
FIG. 11 is a schematic sectional diagram of the display module according to some embodiments of the present disclosure.

In addition, as shown in FIG. 11, the first sounding unit 1 and the second sounding unit 2 arranged in the display module can be separated by a certain distance through the isolation frame 400 to prevent coupling vibration between adjacent sounding units when a sounding unit is driven independently so as to achieve better stereo effect.

Optionally, in the display module, effective sounding areas of the multiple sounding units may be different, and the sounding units with different effective sounding areas can correspond to different resonant frequencies so as to realize a frequency division design. A maximum area of an orthographic projection of the voice coil and the magnetic element on the display panel may be formed into an effective sounding area in one sounding chamber.

It should be noted that the number of sounding units arranged in the entire display module is not limited to only two, more than two sounding units may be provided according to design requirements, and the effective sounding area of each sounding unit and a space between adjacent sounding units may be determined according to sounding design requirements.

According to the display module in the embodiment, the auxiliary layer suspended relative to the display panel is adopted to realize the screen sounding effect, so that direct vibration sounding of the display panel can be avoided, and the problem of screen breakage is avoided.

According to the display module of another embodiment of the present disclosure, the excitation source can drive the display panel to sound, and in order to avoid the risk of screen breakage, the auxiliary layer is contacted with the supporting frame in the embodiment, so that the display panel is not contacted with the supporting frame in the vibration sounding process.

Figure 12:
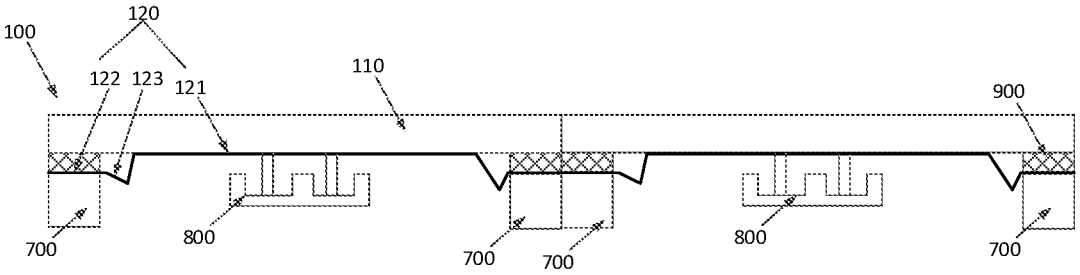
FIG. 12 is a schematic sectional diagram of the display module according to some embodiments of the present disclosure.

FIG. 12 is a schematic sectional diagram of the display module adopting this implementation structure.

When the display panel 110 is connected to the supporting frame 700 through the auxiliary layer 120, the auxiliary layer 120 is disposed on a side, away from a display surface, of the display panel 110, and the supporting frame 700 is fixedly connected to an edge of the display panel 110.

Optionally, the excitation source 800 is disposed on the side, away from the display surface, of the display panel 110 and connected to the auxiliary layer 120. Since the auxiliary layer 120 is fixedly connected to the display panel 110 at a position where the auxiliary layer 120 is connected to the excitation source, the excitation source 800 drives the display panel 110 and the auxiliary layer 120 which are integrally connected to vibrate to generate a sound.

The excitation source 800 includes a voice coil and a magnetic element which are integrally provided, and the principle of generating vibration by using the voice coil and the magnetic element is the same as in the above embodiment and will not be described in detail.

Since the display panel 110 is connected to the supporting frame 700 through the auxiliary layer 120 and is not directly connected to the supporting frame during vibration sounding, a screen breakage risk can be avoided to a certain extent.

Optionally, as shown in FIG. 12, the auxiliary layer 120 includes a first portion 121 fixedly connected to the display panel 110, a second portion 122 connected to the supporting frame 700 and the display panel 110, and a third portion 123 in a bent state disposed between the first portion 121 and the second portion 122.

The third portion 123 in a bent state of the auxiliary layer 120 is not connected to the display panel 110, so that the bent third portion 123 may be used to buffer and reduce the influence of the edges of the fixed display panel on the vibration. Optionally, the first portion 121 projects towards the display panel 110 relative to the second portion 122 such that a height of a portion of the auxiliary layer 120 connected to the display panel 110 is greater than a height of a portion connected to the supporting frame 700 to ensure that the edge of the display panel 110 does not come into contact with a boundary of the supporting frame 700 during vibration of the display panel 110 to avoid the risk of screen breakage.

In the display module of some embodiments of the present disclosure, optionally, as shown in FIG. 12, the second portion 122 is connected to the display panel 110 through a buffer layer 900. That is, the buffer layer 900 is filled between the second portion 122 of the auxiliary layer 120 and the display panel 110; optionally, the buffer layer 900 may be made of a material having a large elastic modulus and being easily deformed such as foam. With the filled buffer layer 900, the influence of the edges of the fixed display panel on the vibration can be further buffered and reduced.

Figure 13:
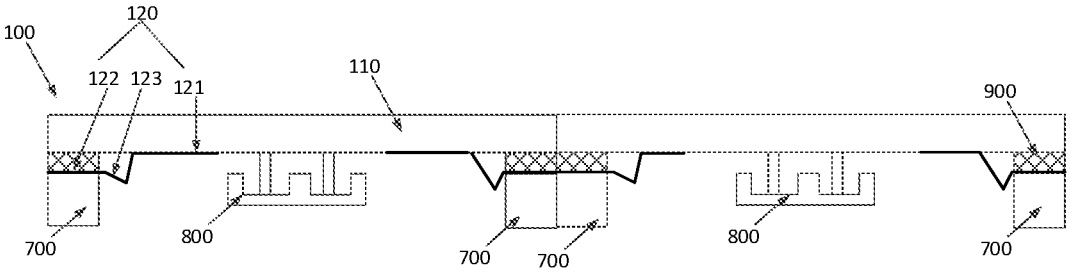
FIG. 13 is a schematic sectional diagram of the display module according to some embodiments of the present disclosure.

As shown in FIG. 13, optionally, the first portion 121, connected to the display panel 110, of the auxiliary layer 120 is provided with through-holes, i.e. in a hollowed-out state, and the excitation source 800 is directly connected to the display panel 110. The excitation source 800 directly drives the display panel 110 to vibrate to generate a sound, the edge of the display panel 110 is sequentially connected to the supporting frame 700 through the buffer layer 900 and the auxiliary layer 120, and the third portion 123 in a bent state is used to buffer and reduce the influence of the edges of the fixed display panel on the vibration.

Figure 14:
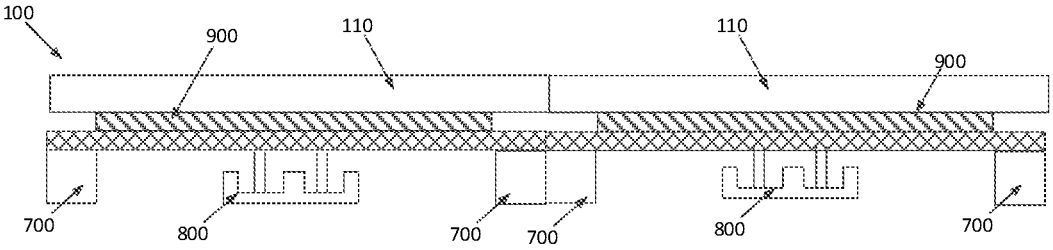
FIG. 14 is a schematic sectional diagram of the display module according to some embodiments of the present disclosure.

As shown in FIG. 14, the auxiliary layer 120 and the display panel 110 are arranged on the supporting frame 700 in parallel, and the buffer layer 900 is arranged between the auxiliary layer 120 and the display panel 110, where an orthographic projection of the buffer layer 900 on a plane of the supporting frame 700 does not coincide with the supporting frame 700. The auxiliary layer 120 is connected to the supporting frame 700, and the buffer layer 900 is arranged between the display panel 110 and the auxiliary layer 120, so that the buffer layer 900 does not coincide with the supporting frame 700, and the display panel 110 is ensured to form a structure with suspended boundaries, when the excitation source 800 drives the display panel 110 to vibrate through the auxiliary layer 120 and the buffer layer 900, the excitation source 800 cannot be influenced by the supporting frame 700 so as to avoid the risk of screen breakage, and the display module is simple in structure and easy to realize the forming process.

It should be noted that the display module of the embodiments shown in FIGS. 12 to 14 may include a plurality of sounding units. Specifically, as shown in FIGS. 12 to 14, the supporting frame 700 divides the display panel 110 into a plurality of areas, and one excitation source 800 is correspondingly arranged in each area to form a sounding unit; the excitation source 800 is used to separately drive the corresponding area to sound. When the plurality of excitation sources 800 are driven at the same time, full-screen vibration sounding can be realized; when one excitation source is driven separately, regional sounding can be achieved.

Optionally, in each sounding unit, the excitation source 800 is located in the middle of the corresponding area. In addition, the connection between the auxiliary layer 120 and the display panel 110 arranged in each sounding unit may be one of the embodiments described above and will not be described in detail.

According to the display module of the embodiment, the auxiliary layer is in contact with the supporting frame, so that the display panel cannot be in contact with the supporting frame in the vibration sounding process, and the risk of screen breakage is avoided.

A display device including the display module as described in any one of the above is further provided in some embodiments of the present disclosure.

With reference to FIGS. 2 to 14, and in light of the above detailed description of the display module, those skilled in the art will appreciate the specific implementation structure of a display device adopting the display module according to some embodiments of the present disclosure and will not be described in detail herein.

A method of forming a display module for implementing the structure above is further provided in some embodiments of the present disclosure, the method includes:

forming a supporting frame;

forming a display sounding structure located on the supporting frame and an excitation source connected to the display sounding structure;

the display sounding structure includes a display panel and an auxiliary layer connected to the display panel; the excitation source is configured to drive the display panel or the auxiliary layer to vibrate and sound; when the excitation source drives the display panel to vibrate and sound, the display panel is connected to the supporting frame through the auxiliary layer; when the excitation source drives the auxiliary layer to vibrate and sound, the auxiliary layer is a transparent film layer arranged at a light-emitting side of the display panel cooperating with the display panel to form a sounding chamber in an enclosing manner.

Optionally, when the auxiliary layer is a transparent film layer arranged at a light-emitting side of the display panel, a voice coil and a magnetic element in the excitation source are arranged separately on the auxiliary layer and the display panel. The step of forming a display sounding structure located on the supporting frame and an excitation source, includes:

when the display panel is manufactured, one of the voice coil and the magnetic element in the excitation source is manufactured at the same time, and an isolation frame is manufactured on the display panel;

the other of the voice coil and the magnetic element in the excitation source located on the auxiliary layer is manufactured; and the auxiliary layer and the display panel are combined to form a display sounding structure.

Optionally, the other of the voice coil and the magnetic element in the excitation source located on the auxiliary layer may be made through a deposition method.

Optionally, the excitation source drives the display panel to vibrate and sound, and when the display panel is connected to the supporting frame through the auxiliary layer, a display sounding structure located on the supporting frame and an excitation source connected to the display sounding structure are manufactured, and the method includes:

forming a display panel;

forming an auxiliary layer on a surface, away from a display surface, of the display panel;

connecting an integrated excitation source with the auxiliary layer or with the display panel through a through-hole in the auxiliary layer to form a display sounding structure; and providing the display sounding structure on a supporting frame.

Optionally, the step of forming an auxiliary layer on a surface, away from a display surface, of the display panel, includes:

forming a filling layer between the display panel and the auxiliary layer and at an edge of a corresponding area, used for forming a sounding unit, of the display panel; where at least one excitation source is arranged in a sounding unit.

According to the above description of the structure of the display module according to some embodiments of the present disclosure, those skilled in the art should be able to understand the detailed process of each step in the above-mentioned method of forming the display module, and the detailed description thereof will not be provided here.

While the foregoing is directed to some embodiments of the present disclosure, it will be understood by those skilled in the art that various improvements and modifications may be made without departing from the principle of the present disclosure, and theses improvement and modifications shall fall within the scope of the present disclosure.

What is claimed is:

1. A display module, comprising:

a display sounding structure, comprising a display panel and an auxiliary layer connected to the display panel;

an excitation source, configured to drive the display panel, wherein the display module further comprises a supporting frame, and the display panel is connected to the supporting frame through the auxiliary layer; or configured to drive the auxiliary layer to vibrate and sound; wherein the auxiliary layer is a transparent film layer arranged at a light-emitting side of the display panel cooperating with the display panel to form a sounding chamber in an enclosing manner, wherein a first member in the excitation source is arranged on the auxiliary layer, and a second member in the excitation source is arranged on the display panel; wherein, the first member is a voice coil and the second member is a magnetic element; or the first member is a magnetic element and the second member is a voice coil, wherein the display panel comprises a plurality of sub-pixel units arranged in an array, wherein an orthographic projection of the first member onto a plane of the display panel is located in a spacing area between adjacent sub-pixel units; the second member is arranged on a same layer as the sub-pixel units of the display panel, and is arranged in the spacing area between adjacent sub-pixel units.

2. The display module according to claim 1, wherein the first member is a continuous preset pattern on the auxiliary layer.

3. The display module according to claim 1, wherein an isolation frame is arranged between the auxiliary layer and the display panel, the isolation frame is connected to the display panel and the auxiliary layer, the isolation frame forms the sounding chamber in an enclosing manner, and the first member and the second member are both located within the sounding chamber.

4. The display module according to claim 3, wherein the first member is a voice coil, and an electrical connection line configured to connect the voice coil to a circuit board of the display panel is arranged in the isolation frame.

5. The display module according to claim 1, wherein the excitation source further comprises a magnetic post arranged on the display panel or the auxiliary layer on which the voice coil is arranged, and the voice coil is arranged around the magnetic post.

6. The display module according to claim 1, wherein the display panel further comprises a circuit board located on a side, away from the auxiliary layer, of the display panel; wherein a first end surface of the second member is fixedly connected to a surface, away from the auxiliary layer, of the display panel, and a second end surface, opposite to the first end surface, of the second member is fixedly connected to the circuit board.

7. The display module according to claim 6, wherein the excitation source further comprises a magnetic post, the second member is a voice coil, and the magnetic post is located on the surface, away from the auxiliary layer, of the display panel.

8. The display module according to claim 1, wherein the magnetic element comprises a first magnetic pole and a second magnetic pole, wherein a direction from the first magnetic pole to the second magnetic pole is parallel to a direction from the auxiliary layer to the display panel.

9. The display module according to claim 1, wherein the display panel is connected to the supporting frame through the auxiliary layer, the auxiliary layer is arranged at a side, away from a display surface, of the display panel, and the supporting frame is fixedly connected to an edge of the display panel.

10. The display module according to claim 9, wherein the auxiliary layer comprises a first portion fixedly connected to the display panel, a second portion connecting the supporting frame and the display panel, and a bent portion in a bent state located between the first portion and the second portion.

11. The display module according to claim 10, wherein the second portion is connected to the display panel through a buffer layer.

12. The display module according to claim 10, wherein the excitation source is fixedly connected to the first portion of the auxiliary layer.

13. The display module according to claim 10, wherein the first portion of the auxiliary layer is provided with a through-hole to expose a partial surface of the display panel, and the excitation source is in direct contact with and fixedly connected to the partial surface of the display panel.

14. The display module according to claim 1, wherein the display panel is connected to the supporting frame through the auxiliary layer, the auxiliary layer is parallel to an extension direction of the display panel, a buffer layer is arranged between the auxiliary layer and the display panel, and an orthographic projection of the buffer layer onto a plane of the supporting frame does not coincide with the supporting frame.

15. The display module according to claim 14, wherein the excitation source is fixedly connected to the auxiliary layer.

16. The display module according to claim 1, wherein a plurality of excitation sources are provided, and each excitation source is arranged corresponding to an area of the display panel to form a sounding unit.

17. A display device comprising the display module of claim 1.

18. A display module, comprising:

a display sounding structure, comprising a display panel and an auxiliary layer connected to the display panel;

an excitation source, configured to drive the display panel, wherein the display module further comprises a supporting frame, and the display panel is connected to the supporting frame through the auxiliary layer; or configured to drive the auxiliary layer to vibrate and sound; wherein the auxiliary layer is a transparent film layer arranged at a light-emitting side of the display panel cooperating with the display panel to form a sounding chamber in an enclosing manner, wherein a first member in the excitation source is arranged on the auxiliary layer, and a second member in the excitation source is arranged on the display panel; wherein, the first member is a voice coil and the second member is a magnetic element; or the first member is a magnetic element and the second member is a voice coil, wherein an isolation frame is arranged between the auxiliary layer and the display panel, the isolation frame is connected to the display panel and the auxiliary layer, the isolation frame forms the sounding chamber in an enclosing manner, and the first member and the second member are both located within the sounding chamber.

19. The display module according to claim 18, wherein the first member is a voice coil, and an electrical connection line configured to connect the voice coil to a circuit board of the display panel is arranged in the isolation frame.

20. A display module, comprising:

a display sounding structure, comprising a display panel and an auxiliary layer connected to the display panel;

an excitation source, configured to drive the display panel, wherein the display module further comprises a supporting frame, and the display panel is connected to the supporting frame through the auxiliary layer; or configured to drive the auxiliary layer to vibrate and sound; wherein the auxiliary layer is a transparent film layer arranged at a light-emitting side of the display panel cooperating with the display panel to form a sounding chamber in an enclosing manner, wherein a first member in the excitation source is arranged on the auxiliary layer, and a second member in the excitation source is arranged on the display panel; wherein, the first member is a voice coil and the second member is a magnetic element; or the first member is a magnetic element and the second member is a voice coil, wherein the display panel further comprises a circuit board located on a side, away from the auxiliary layer, of the display panel; wherein a first end surface of the second member is fixedly connected to a surface, away from the auxiliary layer, of the display panel, and a second end surface, opposite to the first end surface, of the second member is fixedly connected to the circuit board.

* * * * *